US010180271B2

(12) United States Patent
Hirayama et al.

(10) Patent No.: US 10,180,271 B2
(45) Date of Patent: Jan. 15, 2019

(54) MULTIPLE CYLINDER ROTARY COMPRESSOR AND REFRIGERATION CYCLE APPARATUS

(71) Applicant: Toshiba Carrier Corporation, Kawasaki-shi, Kanagawa-ken (JP)

(72) Inventors: Takuya Hirayama, Shizuoka-ken (JP); Isao Kawabe, Shizuoka-ken (JP)

(73) Assignee: TOSHIBA CARRIER CORPORATION, Kawasaki-Shi (JP)

( * ) Notice: Subject to any disclaimer, the term of this patent is extended or adjusted under 35 U.S.C. 154(b) by 0 days.

(21) Appl. No.: 14/866,409

(22) Filed: Sep. 25, 2015

(65) Prior Publication Data

US 2016/0018136 A1 Jan. 21, 2016

Related U.S. Application Data

(63) Continuation of application No. PCT/JP2014/000711, filed on Feb. 12, 2014.

(30) Foreign Application Priority Data

Mar. 26, 2013 (JP) ..... 2013-064292

(51) Int. Cl.
*F25B 9/00* (2006.01)
*F04C 18/356* (2006.01)
(Continued)

(52) U.S. Cl.
CPC ..... *F25B 9/00* (2013.01); *F01C 21/02* (2013.01); *F04C 18/356* (2013.01);
(Continued)

(58) Field of Classification Search
CPC ..... F01C 21/02; F04C 29/0085; F04C 29/12; F04C 23/008; F04C 23/001; F04C 18/356;
(Continued)

(56) References Cited

U.S. PATENT DOCUMENTS 4,508,495 A 4/1985 Monden et al.
5,152,156 A * 10/1992 Tokairin ..... F04C 18/3564 417/286
(Continued)

FOREIGN PATENT DOCUMENTS

CN 100447424 12/2008
JP S58-220991 12/1983
(Continued)

OTHER PUBLICATIONS

14866409—ProQuestTransWO2011114750A1.*
(Continued)

*Primary Examiner* — Charles Freay
*Assistant Examiner* — Lilya Pekarskaya
(74) *Attorney, Agent, or Firm* — DLA Piper LLP US

(57) ABSTRACT

The multiple cylinder rotary compressor includes a compressor body including a hermetic case, the hermetic case housing inside a rotating shaft, an electric motor section, and a compression mechanism body. The compression mechanism body includes at least three compression mechanism sections which stack with each other, partition plates between the corresponding adjacent compression mechanism sections, and a primary bearing and a secondary bearing supporting the rotating shaft on both end sides of the compression mechanism body. The compression mechanism sections include a cylinder forming inside a cylinder chamber, an eccentric section provided to the rotating shaft, disposed in the cylinder chamber, a roller fitted to the eccentric section, rotating eccentrically within the cylinder chamber, and a blade dividing the inside of the cylinder chamber into two. At least one partition plate constitutes a partition plate bearing supporting the rotating shaft.

3 Claims, 6 Drawing Sheets

(51) Int. Cl.

| | |
|---|---|
| ***F01C 21/02*** | (2006.01) |
| ***F04C 29/12*** | (2006.01) |
| ***F04C 29/00*** | (2006.01) |
| ***F25B 1/04*** | (2006.01) |
| ***F25B 49/02*** | (2006.01) |
| *F04C 23/00* | (2006.01) |

(52) U.S. Cl.
CPC ..... *F04C 23/008* (2013.01); *F04C 29/0085* (2013.01); *F04C 29/12* (2013.01); *F25B 1/04* (2013.01); *F25B 49/02* (2013.01); *F04C 23/001* (2013.01); *F04C 2240/56* (2013.01); *F04C 2240/601* (2013.01)

(58) Field of Classification Search
CPC ..... F04C 2240/05; F04C 2240/6016; F25B 9/00; F25B 1/04; F25B 49/02
USPC ..... 417/410.3
See application file for complete search history.

(56) References Cited

U.S. PATENT DOCUMENTS

| | | | | |
|---|---|---|---|---|
| 5,322,424 | A * | 6/1994 | Fujio | F04C 18/3564 418/11 |
| 6,651,458 | B1 * | 11/2003 | Ebara | F04C 18/3564 62/510 |
| 7,748,968 | B2 * | 7/2010 | Morozumi | F04C 18/3564 417/410.3 |
| 2003/0068236 | A1 * | 4/2003 | Tadano | F01C 21/0809 417/312 |
| 2005/0051715 | A1 * | 3/2005 | Okada | G01D 5/34 250/231.13 |
| 2005/0069423 | A1 * | 3/2005 | Ebara | F04C 18/3564 417/313 |
| 2010/0147013 | A1 * | 6/2010 | Hirayama | F04C 18/356 62/401 |
| 2010/0326128 | A1 * | 12/2010 | Sotojima | F04C 18/02 62/498 |
| 2013/0294956 | A1 * | 11/2013 | Ito | F04C 18/0223 418/55.2 |

FOREIGN PATENT DOCUMENTS

| | | | | |
|---|---|---|---|---|
| JP | H02-25037 | | 5/1990 | |
| JP | H03-55233 | | 8/1991 | |
| JP | WO 2005124156 | A1 * | 12/2005 | F04C 18/3564 |
| JP | 4594302 | | 12/2010 | |
| JP | 2011-64183 | | 3/2011 | |
| JP | 2011064183 | A * | 3/2011 | |
| JP | WO 2011114750 | A1 * | 9/2011 | F01C 21/0809 |
| JP | 2012-122400 | | 6/2012 | |
| JP | 2012122400 | A * | 6/2012 | |
| JP | WO 2014155938 | A1 * | 10/2014 | F01C 21/02 |
| WO | WO/2005/124156 | A1 * | 12/2005 | |
| WO | WO2005124156 | A * | 12/2010 | F04C 18/3564 |

OTHER PUBLICATIONS

14866409—Trans-Orgin—JPH051686A.*
14866409—ProQuestTransJP2012122400A.*
Raw machine trasnslation of WO/2005/124156 A1, "Multi-Cylinder Rotary Compressor", Onoda et al., Dec. 2005.*
International Search Report (with English Translation) issued in PCT/JP2014/000711 dated May 27, 2014.
Written Opinion ((with English Translation) issued in PCT/JP2014/000711 dated May 27, 2014.
International Preliminary Report on Patentability issued in PCT/JP2014/000711 dated Sep. 29, 2015.
Chinese Office Action (with English Translation) issued in CN 201480003474.X dated Mar. 28, 2016.
English Language Abstract of JP 4594302 published on Dec. 8, 2010.
English Language Abstract of JP H02-25037 published on May 31, 1990.
English Language Abstract of JP S58-220991 published on Dec. 22, 1983.
English Language Translation of JP H03-55233 published on Aug. 22, 1991.
English Language Translation of JP 2011-64183 published on Mar. 31, 2011.
English Language Translation of JP 2012-122400 published on Jun. 28, 2012.
English Language Translation of CN 100447424 published on Dec. 31, 2008.

* cited by examiner

MULTIPLE CYLINDER ROTARY COMPRESSOR AND REFRIGERATION CYCLE APPARATUS

CROSS-REFERENCE TO RELATED APPLICATIONS

This application is a Continuation Application of International Application No. PCT/JP2014/000711, filed on Feb. 12, 2014, which, in turn, is based upon and claims the benefit of priority from the prior Japanese Patent Application No. 2013-064292, filed on Mar. 26, 2013. The entire contents of both applications are incorporated herein by reference.

FIELD

Embodiments described herein relate generally to a multiple cylinder rotary compressor and a refrigeration cycle apparatus including the multiple cylinder rotary compressor.

BACKGROUND

Although a multiple cylinder rotary compressor used in a refrigeration cycle apparatus such as air-conditioning equipment includes generally two compression mechanism sections, a multiple cylinder rotary compressor including three or more compression mechanism sections is known to increase the discharge amount of the compressed gas refrigerant (see the following Patent Literature 1 and 2).

In the multiple cylinder rotary compressor described in Patent Literature 1, three compression mechanism sections are arranged in the axial direction of the rotating shaft, and the rotating shaft is supported by a pair of bearings (a primary bearing and a secondary bearing) positioned on both sides of these three compression mechanism sections.

In addition, in the multiple cylinder rotary compressor described in Patent Literature 2, the rotating shaft is divided in the shaft center direction, and a bearing is disposed between the compression mechanism sections so that the deflection or bend of the rotating shaft is reduced, and the divided rotating shaft is made synchronously rotatable.

[Patent Literature 1] Japanese Patent No. 4594302

[Patent Literature 2] Japanese Unexamined Patent Application Publication No. 2012-122400

DETAILED DESCRIPTION

Figure 1:
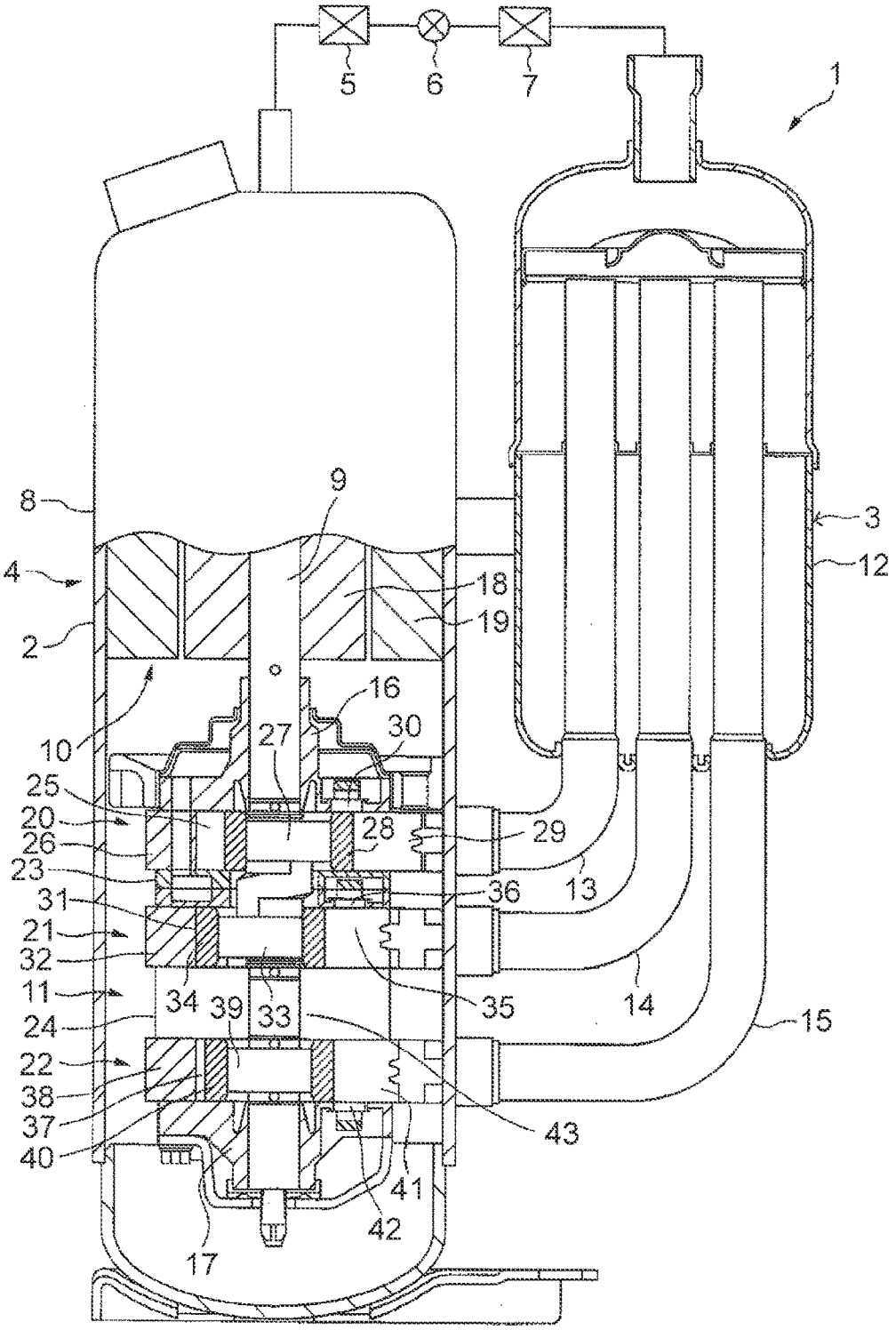
FIG. 1 is a configuration diagram of a refrigeration cycle apparatus including a multiple cylinder rotary compressor shown in cross-section in a first embodiment.

However, in the multiple cylinder rotary compressor described in Patent Literature 1, the rotating shaft is supported by the two bearings disposed on both sides of the three compression mechanism sections; therefore, the distance between the bearings is increased, a large deflection is likely to occur in the rotating shaft by the compression reaction force and the rotational unbalance, and the compression performance and the reliability are lowered.

In addition, in the multiple cylinder rotary compressor described in Patent Literature 2, a mechanism for rotating synchronously the divided rotating shafts is needed, and this mechanism includes a complex structure and a large number of components, and therefore, the cost increases. Furthermore, it is difficult to align the whole shaft center of each of the compression mechanism sections with high accuracy during the assembly, and the compression performance and the reliability are prone to variations for each of multiple cylinder rotary compressors.

The purpose of the embodiments according to the present invention is to provide a multiple cylinder rotary compressor capable of reducing the deflection of the rotating shaft and simplifying the mechanism for supporting the rotating shaft, and a refrigeration cycle apparatus including the multiple cylinder rotary compressor, out of multiple cylinder rotary compressors having three or more compression mechanism sections.

The multiple cylinder rotary compressor in the embodiments includes: a compressor body including a hermetic case, the hermetic case housing inside a rotating shaft rotatable around a shaft center, an electric motor section connected to one end side of the rotating shaft, and a compression mechanism body connected to the other end side of the rotating shaft; the compression mechanism body including: at least three compression mechanism sections arranged so as to stack with each other in an axial direction of the rotating shaft, partition plates each of which disposed between the corresponding adjacent compression mechanism sections, and a primary bearing and a secondary bearing supporting the rotating shaft on both end sides of the compression mechanism body along the axial direction of the rotating shaft; and the compression mechanism sections each of which including: a cylinder forming inside a cylinder chamber, an eccentric section provided to the rotating shaft, disposed in the cylinder chamber, a roller fitted to the eccentric section, rotating eccentrically within the cylinder chamber with the rotation of the rotating shaft, and a blade dividing the inside of the cylinder chamber into two, wherein at least one partition plate of the partition plates constitutes a partition plate bearing supporting the rotating shaft.

In addition, the refrigeration cycle apparatus in the embodiments includes: a multiple cylinder rotary compressor described above; a condenser connected to the multiple cylinder rotary compressor; an expansion device connected to the condenser; and an evaporator connected between the expansion device and the multiple cylinder rotary compressor. As a result, in the multiple cylinder rotary compressor and the refrigeration cycle apparatus having three or more compression mechanism sections, the deflection of the rotating shaft can be reduced, moreover, the mechanism for supporting the rotating shaft can be simplified.

In the following, embodiments of the present invention will be described with reference to the drawings.

First Embodiment

The first embodiment will be described with reference to FIGS. 1 and 2. FIG. 1 shows a refrigeration cycle apparatus 1, and this refrigeration cycle apparatus 1 includes a multiple cylinder rotary compressor 4 including a compressor body 2 and an accumulator 3 installed next to the compressor body 2, a condenser 5 connected to the discharge side of the compressor body 2, an expansion device 6 connected to the condenser 5, and an evaporator 7 connected between the expansion device 6 and the accumulator 3. In the refrigeration cycle apparatus 1, a refrigerant being the working fluid is circulated, and the heat dissipation from the refrigerant and the heat absorption to the refrigerant are repeated.

The compressor body 2 includes a hermetic case 8 formed in a cylindrical shape, and the hermetic case 8 houses a rotating shaft 9 having a shaft center in the vertical direction, rotatable around the shaft center, an electric motor section 10 connected to one end side of the rotating shaft 9 (upper end side), and a compression mechanism body 11 connected to the other end side of the rotating shaft 9 (lower end side).

The accumulator 3 includes a hermetic case 12 formed in a cylindrical shape, separates the liquid refrigerant contained in the refrigerant circulating in the refrigeration cycle apparatus 1 within this hermetic case 12, and only the gas refrigerant from which the liquid refrigerant is separated is supplied to the compression mechanism body 11 through three suction pipes (the first suction pipe 13, the second suction pipe 14, and the third suction pipe 15). These first to third suction pipes 13, 14, 15 are disposed through the bottom portion of the accumulator 3, one end is open at the upper position in the accumulator 3, and the other end is connected to the compression mechanism body 11 through the side surface of the hermetic case 8.

The condenser 5 condenses the high-pressure gas refrigerant discharged from the compressor body 2 into the liquid refrigerant.

The expansion device 6 decompresses the liquid refrigerant condensed in the condenser 5.

The evaporator 7 evaporates the liquid refrigerant decompressed in the expansion device 6.

The rotating shaft 9 has a shaft center in the vertical direction, is supported by a primary bearing 16, a secondary bearing 17, and a partition plate bearing described below, and is provided rotatably around the shaft center. The portion between the supporting points by the primary bearing 16 and the secondary bearing 17 (the intermediate portion) in the rotating shaft 9 includes three eccentric sections described below.

The electric motor section 10 includes a rotor 18 fixed to the rotating shaft 9, configured to rotate integrally with the rotating shaft 9, and a stator 19 fixed to the inside of the hermetic case 8, disposed in a position surrounding the rotor 18. The rotor 18 includes a permanent magnet (not shown), and the stator 19 is wound with a coil for energizing (not shown).

The compression mechanism body 11 includes three compression mechanism sections arranged so as to stack with each other in the axial direction of the rotating shaft 9 (the first compression mechanism section 20, the second compression mechanism section 21, and the third compression mechanism section 22); two partition plates 23 and 24 (the first partition plate 23 disposed between the first compression mechanism section 20 and the second compression mechanism section 21, and the second partition plate 24 disposed between the second compression mechanism section 21 and the third compression mechanism section 22) each of which arranged between the adjacent two compression mechanism sections among these three compression mechanism sections, partitioning between the adjacent compression mechanism sections; and the above-described primary bearing 16 and the secondary bearing 17 supporting the rotating shaft 9 on both end sides of the compression mechanism body 11 along the axial direction of the rotating shaft 9.

The first compression mechanism section 20 includes a first cylinder 26 forming inside a first cylinder chamber 25, the upper end surface of the first cylinder chamber 25 is closed by the primary bearing 16, and the lower end surface of the first cylinder chamber 25 is closed by the first partition plate 23.

A first eccentric section 27 formed integrally with the rotating shaft 9 is positioned in the first cylinder chamber 25, and a first roller 28 is fitted into this first eccentric section 27.

The first roller 28 is disposed so as to eccentrically rotate in the first cylinder chamber 25 while keeping the outer peripheral surface of the first roller 28 in line contact with the inner peripheral surface of the first cylinder 26 during the rotation of the rotating shaft 9. The first cylinder 26 includes a first blade 29 capable of reciprocating movement, configured to divide the inside of the first cylinder chamber 25 into two spaces of the suction chamber and the compression chamber along the rotating direction of the first roller 28 by allowing the tip end portion to abut on the outer peripheral surface of the first roller 28.

The first suction pipe 13 is connected to the first cylinder chamber 25. In the primary bearing 16, a first discharge hole 30 through which the gas refrigerant compressed in the first cylinder chamber 25 into high pressure is discharged from the inside of the first cylinder chamber 25 into the space in the hermetic case 8 is formed.

The second compression mechanism section 21 includes a second cylinder 32 forming inside a second cylinder chamber 31, the upper end surface of the second cylinder chamber 31 is closed by the first partition plate 23, and the lower end surface of the second cylinder chamber 31 is closed by the second partition plate 24.

A second eccentric section 33 formed integrally with the rotating shaft 9 is positioned in the second cylinder chamber 31, and a second roller 34 is fitted into this second eccentric section 33.

The second roller 34 is disposed so as to eccentrically rotate in the second cylinder chamber 31 while keeping the outer peripheral surface of the second roller 34 in line contact with the inner peripheral surface of the second cylinder 32 during the rotation of the rotating shaft 9. The second cylinder 32 includes a second blade 35 capable of reciprocating movement, configured to divide the inside of the second cylinder chamber 31 into two spaces of the suction chamber and the compression chamber along the rotating direction of the second roller 34 by allowing the tip end portion to abut on the outer peripheral surface of the second roller 34.

The second suction pipe 14 is connected to the second cylinder chamber 31. In the first partition plate 23, a second discharge hole 36 through which the gas refrigerant compressed in the second cylinder chamber 31 into high pressure is discharged from the inside of the second cylinder chamber 31 into the space in the hermetic case 8 is formed.

The third compression mechanism section 22 includes a third cylinder 38 forming inside a third cylinder chamber 37, the upper end surface of the third cylinder chamber 37 is closed by the second partition plate 24, and the lower end surface of the third cylinder chamber 37 is closed by the secondary bearing 17.

A third eccentric section 39 formed integrally with the rotating shaft 9 is positioned in the third cylinder chamber 37, and a third roller 40 is fitted into this third eccentric section 39.

The third roller 40 is disposed so as to eccentrically rotate in the third cylinder chamber 37 while keeping the outer peripheral surface of the third roller 40 in line contact with the inner peripheral surface of the third cylinder 38 during the rotation of the rotating shaft 9. The third cylinder 38 includes a third blade 41 capable of reciprocating movement, configured to divide the inside of the third cylinder chamber 37 into two spaces of the suction chamber and the compression chamber along the rotating direction of the third roller 40 by allowing the tip end portion to abut on the outer peripheral surface of the third roller 40.

The third suction pipe 15 is connected to the third cylinder chamber 37. In the secondary bearing 17, a third discharge hole 42 through which the gas refrigerant compressed in the third cylinder chamber 37 into high pressure is discharged from the inside of the third cylinder chamber 37 into the space in the hermetic case 8 is formed.

The three eccentric sections formed in the rotating shaft 9 (the first eccentric section 27, the second eccentric section 33, and the third eccentric section 39) are formed in the same external dimensions and eccentric amount with respect to the rotation center, and are formed at an interval of 120° along the circumferential direction of the rotating shaft 9.

Here, the second partition plate 24 constitutes the partition plate bearing 43 supporting the rotating shaft 9 by keeping the second partition plate 24 in sliding contact with the outer peripheral surface of the rotating shaft 9. Furthermore, the second partition plate 24 is formed by being divided into two as shown in FIG. 2, leads the divided end surfaces 44 to abut, and is interposed between the second cylinder 32 and the third cylinder 38, whereby the second partition plate 24 is built in the compression mechanism body 11.

In such a configuration, in this multiple cylinder rotary compressor 4, the electric motor section 10 is energized, whereby the rotating shaft 9 rotates on the shaft center; the first to third rollers 28, 34, and 40 rotate eccentrically in the first to third cylinder chambers 25, 31, and 37 along with the rotation of the rotating shaft 9; and the first to third compression mechanism sections 20, 21, and 22 are driven.

When the first to third compression mechanism sections 20, 21, and 22 are driven, a low-pressure gas refrigerant from the inside of the accumulator 3 is sucked into the first to third cylinder chambers 25, 31, and 37 through the first to third suction pipes 13, 14, and 15, and the sucked low-pressure gas refrigerant is compressed into a high-pressure gas refrigerant.

The gas refrigerant reaching high pressure in the first to third cylinder chambers 25, 31, and 37 is discharged from the first to third discharge holes 30, 36, and 42 into the hermetic case 8 of the compressor body 2. The high-pressure gas refrigerant discharged into the hermetic case 8 circulates through the condenser 5, the expansion device 6, the evaporator 7, and the accumulator 3, and becomes a low-pressure gas refrigerant to be sucked again from the accumulator 3 into the first to third cylinder chambers 25, 31, and 37.

Here, in this multiple cylinder rotary compressor 4, the rotating shaft 9 is supported by the primary bearing 16 and the secondary bearing 17 positioned on both end sides of the compression mechanism body 11, and is further supported by the partition plate bearing 43 being the second partition plate 24 disposed inside the compression mechanism body 11.

For this reason, during the operation of the multiple cylinder rotary compressor 4 where the first to third compression mechanism sections 20, 21, and 22 are driven, even when the force in the direction of deflecting the rotating shaft 9 acts on the rotating shaft 9 due to the compression reaction force and rotational unbalance, the deflection of the rotating shaft 9 can be reduced, and the multiple cylinder rotary compressor 4 with high compression performance and reliability can be provided.

In the compression mechanism body 11, two compression mechanism sections (the first and the second compression mechanism sections 20 and 21) are positioned on the electric motor section 10 side of the second partition plate 24 constituting the partition plate bearing 43, and one compression mechanism section (the third compression mechanism section 22) is positioned on the opposite side.

The comparison of the bearing length (length dimensions in the axial direction supporting the rotating shaft 9) between the primary bearing 16 and the secondary bearing 17 shows that the primary bearing 16 is formed larger, namely, longer, than the secondary bearing 17 so as to prevent the whirling and the like of the electric motor section 10.

As the result, two compression mechanism sections are disposed between the primary bearing 16 having a large bearing length and the second partition plate 24, and one compression mechanism section is disposed on the opposite side, whereby the deflection of the rotating shaft 9 can be efficiently reduced.

Figure 2:
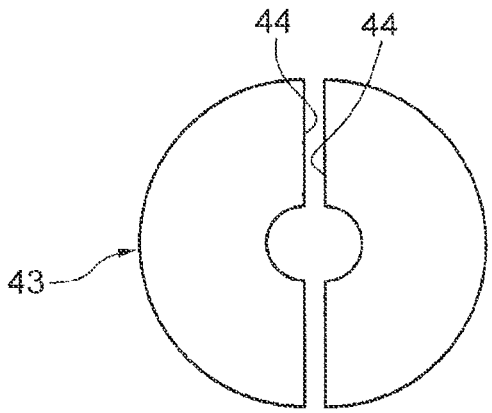
FIG. 2 is a plan view showing a partition plate constituting a partition plate bearing in a divided state.
Figure 3:
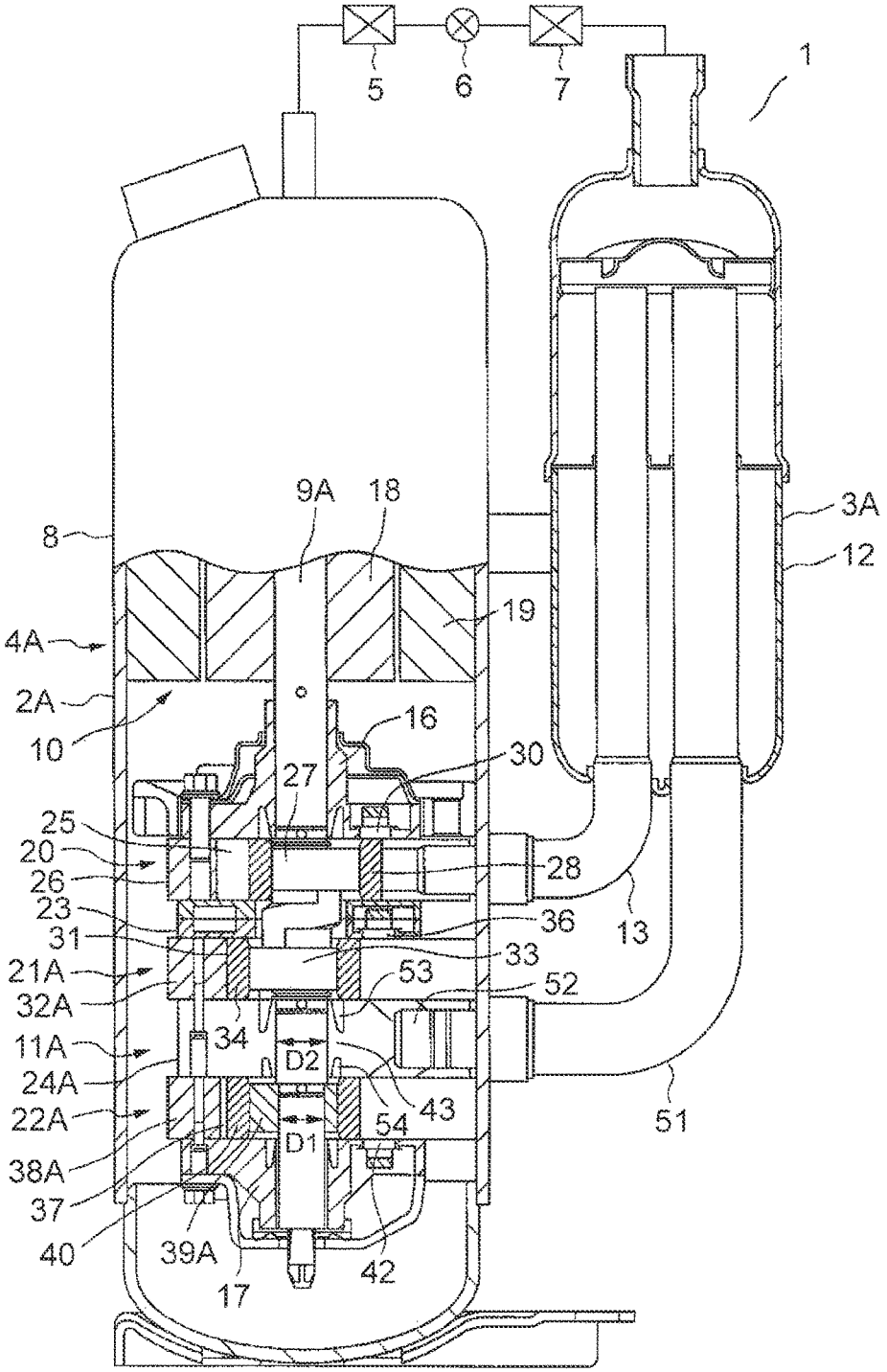
FIG. 3 is a configuration diagram of a refrigeration cycle apparatus including a multiple cylinder rotary compressor shown in cross-section in a second embodiment.

In addition, the second partition plate 24 constituting the partition plate bearing 43 is formed by being divided as shown in FIG. 2, and therefore, even when the second and the third eccentric sections 33 and 39 are positioned on both sides in the axial direction of the attachment position of this second partition plate 24, the attachment of the second partition plate 24 to the rotating shaft 9 can be easily performed.

Furthermore, the deflection prevention of the rotating shaft 9 during the operation of the multiple cylinder rotary compressor 4 can be performed by the simple configuration that the three bearings of the primary bearing 16, the secondary bearing 17, and the partition plate bearing 43 support the rotating shaft 9.

It should be noted that although the compressor body 2 including three compression mechanism sections 20, 21, and 22 is described as an example in this embodiment, the number of compression mechanism sections may be four or more.

Second Embodiment

The second embodiment will be described with reference to FIGS. 3 to 6. It should be noted that the same component as described in the first embodiment will be given the same reference numeral, and that an overlapping description will be omitted.

The basic configuration in the second embodiment is the same as in the first embodiment, and the multiple cylinder rotary compressor 4A in the second embodiment includes a compressor body 2A and an accumulator 3A.

The compressor body 2A includes a hermetic case 8 formed in a cylindrical shape, and the hermetic case 8 houses a rotating shaft 9A having a shaft center in the vertical direction, rotatable around the shaft center, an electric motor section 10 connected to one end side of the rotating shaft 9A (upper end side), and a compression mechanism body 11A connected to the other end side of the rotating shaft 9A (lower end side).

The accumulator 3A includes a hermetic case 12 formed in a cylindrical shape, separates the liquid refrigerant contained in the refrigerant circulating in the refrigeration cycle apparatus 1 within this hermetic case 12, and only the gas refrigerant from which the liquid refrigerant is separated is supplied to the compression mechanism body 11A through two suction pipes (the first suction pipe 13 and the second suction pipe 51). These first and second suction pipes 13 and 51 are disposed through the bottom portion of the accumulator 3A, one end is open at the upper position in the accumulator 3A, and the other end is connected to the compression mechanism body 11A through the side surface of the hermetic case 8.

The rotating shaft 9A has a shaft center in the vertical direction, is supported by three bearings of a primary bearing 16, a secondary bearing 17, and a partition plate bearing described below, and is provided rotatably around the shaft center.

The intermediate portion of the supporting points by the primary bearing 16 and the secondary bearing 17 in the rotating shaft 9A includes three eccentric sections (the first eccentric section 27, the second eccentric section 33, and the third eccentric section 39A).

The first eccentric section 27 and the second eccentric section 33 are formed integrally with the rotating shaft 9A in the same manner as in the first embodiment. Besides, the third eccentric section 39A is formed by a separate component from the rotating shaft 9A and is attached to the rotating shaft 9A.

The attachment of the third eccentric section 39A to the rotating shaft 9A is performed by press fit, shrink fit (thermal insert), cooling fit, key coupling, and the like. The first and the second eccentric sections 27 and 33 and the third eccentric section 39A are formed in the same external dimensions and eccentric amount with respect to the rotation center.

The compression mechanism body 11A includes three compression mechanism sections in the axial direction of the rotating shaft 9A (the first compression mechanism section 20, the second compression mechanism section 21A, and the third compression mechanism section 22A); two partition plates 23 and 24A (the first partition plate 23 disposed between the first compression mechanism section 20 and the second compression mechanism section 21A, and the second partition plate 24A disposed between the second compression mechanism section 21A and the third compression mechanism section 22A) each of which arranged between the adjacent two compression mechanism sections among these three compression mechanism sections, partitioning between the adjacent compression mechanism sections; and the primary bearing 16 and the secondary bearing 17 supporting the rotating shaft 9A on both end sides of the compression mechanism body 11A along the axial direction of the rotating shaft 9A.

The second compression mechanism section 21A includes a second cylinder 32A forming inside a second cylinder chamber 31, the upper end surface of the second cylinder chamber 31 is closed by the first partition plate 23, and the lower end surface of the second cylinder chamber 31 is closed by the second partition plate 24A.

A second eccentric section 33 formed integrally with the rotating shaft 9A is positioned in the second cylinder chamber 31, and a second roller 34 is fitted into this second eccentric section 33.

The second roller 34 is disposed so as to eccentrically rotate in the second cylinder chamber 31 while keeping the outer peripheral surface of the second roller 34 in line contact with the inner peripheral surface of the second cylinder 32A during the rotation of the rotating shaft 9A. The second cylinder 32A includes a second blade 35 (see FIG. 1) capable of reciprocating movement, configured to divide the inside of the second cylinder chamber 31 into two spaces of the suction chamber and the compression chamber along the rotating direction of the second roller 34 by allowing the tip end portion to abut on the outer peripheral surface of the second roller 34.

A suction passage 52 to which the second suction pipe 51 is connected is formed in the second partition plate 24A, and this suction passage 52 and the second cylinder chamber 31 are connected. The second discharge hole 36 through which the gas refrigerant compressed in the second cylinder chamber 31 into high pressure is discharged is formed in the first partition plate 23 positioned on the opposite side of the side where the second cylinder chamber 31 and the suction passage 52 are connected.

The third compression mechanism section 22A includes a third cylinder 38A forming inside a third cylinder chamber 37, the upper end surface of the third cylinder chamber 37 is closed by the second partition plate 24A, and the lower end surface of the third cylinder chamber 37 is closed by the secondary bearing 17.

A third eccentric section 39A formed by a separate component from the rotating shaft 9A is positioned in the third cylinder chamber 37, and a third roller 40 is fitted into this third eccentric section 39.

The third roller 40 is disposed so as to eccentrically rotate in the third cylinder chamber 37 while keeping the outer peripheral surface of the third roller 40 in line contact with the inner peripheral surface of the third cylinder 38A during the rotation of the rotating shaft 9A. The third cylinder 38A includes a third blade 41 (see FIG. 1) capable of reciprocating movement, configured to divide the inside of the third cylinder chamber 37 into two spaces of the suction chamber and the compression chamber along the rotating direction of the third roller 40 by allowing the tip end portion to abut on the outer peripheral surface of the third roller 40.

The third cylinder chamber 37 is connected to the suction passage 52 formed in the second partition plate 24A. The third discharge hole 42 through which the gas refrigerant compressed in the third cylinder chamber 37 into high pressure is discharged is formed in the secondary bearing 17 positioned on the opposite side of the side where the third cylinder chamber 37 and the suction passage 52 are connected.

Here, the second partition plate 24A constitutes the partition plate bearing 43 supporting the rotating shaft 9A by keeping the second partition plate 24A in sliding contact with the outer peripheral surface of the rotating shaft 9A. The second partition plate 24A is not divided as described in the first embodiment, but is formed as a doughnut-shaped component, i.e., as one component.

In addition, annular grooves 53 and 54, positioned on the periphery of the partition plate bearing 43 and opened toward the sides of the second and the third compression mechanism sections 21A and 22A, are formed on both end surfaces of the second partition plate 24A. The annular groove 53 opened toward the side where the two compression mechanism sections 21A and 20 are positioned is formed to have large depth dimensions compared to the annular groove opened toward the side where the one compression mechanism section 22A is positioned.

The third eccentric section 39A, formed by a separate component from the rotating shaft 9A and attached to the rotating shaft 9A, is disposed on the opposite side of the electric motor section 10 across the second partition plate 24A constituting the partition plate bearing 43.

The external dimension "D1" of the rotating shaft 9A in the portion positioned on the opposite side of the electric motor section 10 across the second partition plate 24A in the rotating shaft 9A is formed to be smaller than the sliding diameter dimension "D2" of the partition plate bearing 43.

Figure 4:
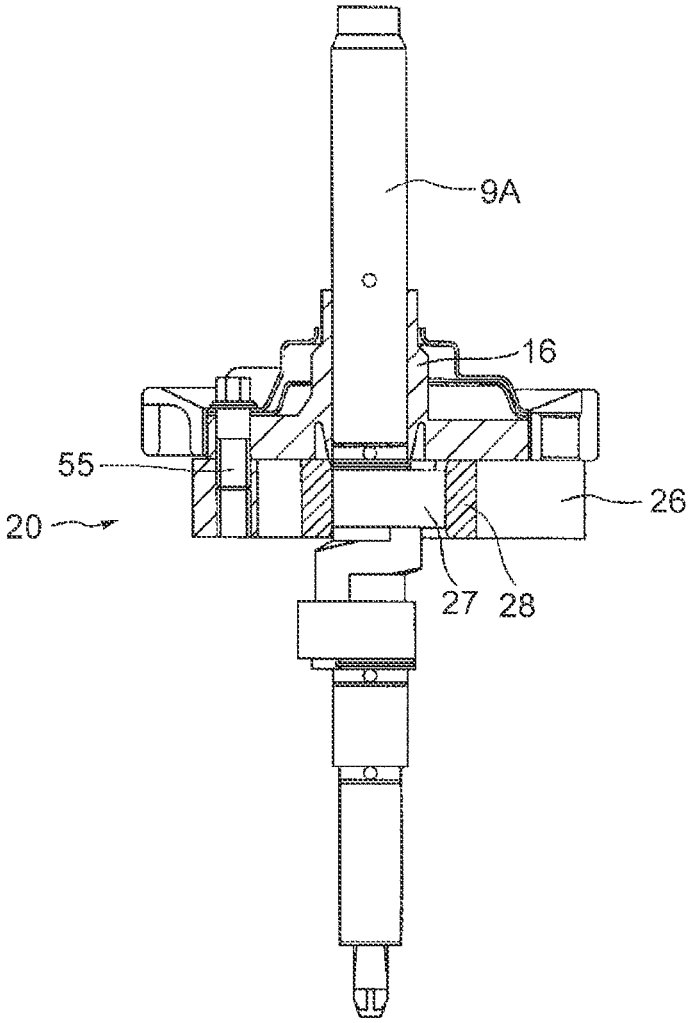
FIG. 4 is a cross sectional view showing an assembling procedure of a compression mechanism body.
Figure 5:
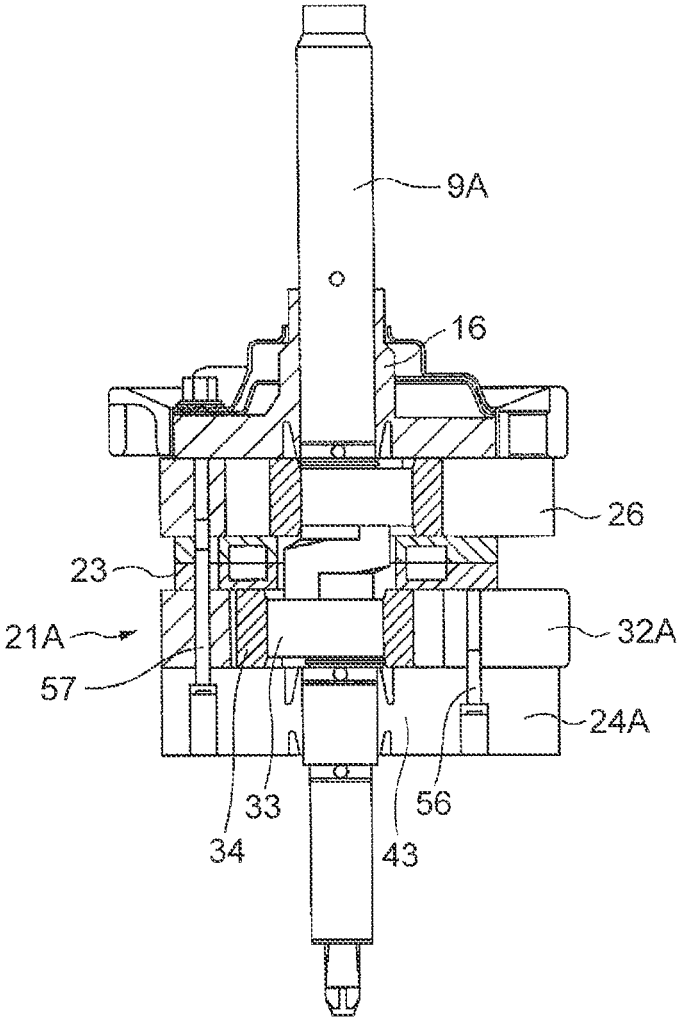
FIG. 5 is a cross sectional view showing an assembling procedure of a compression mechanism body.
Figure 6:
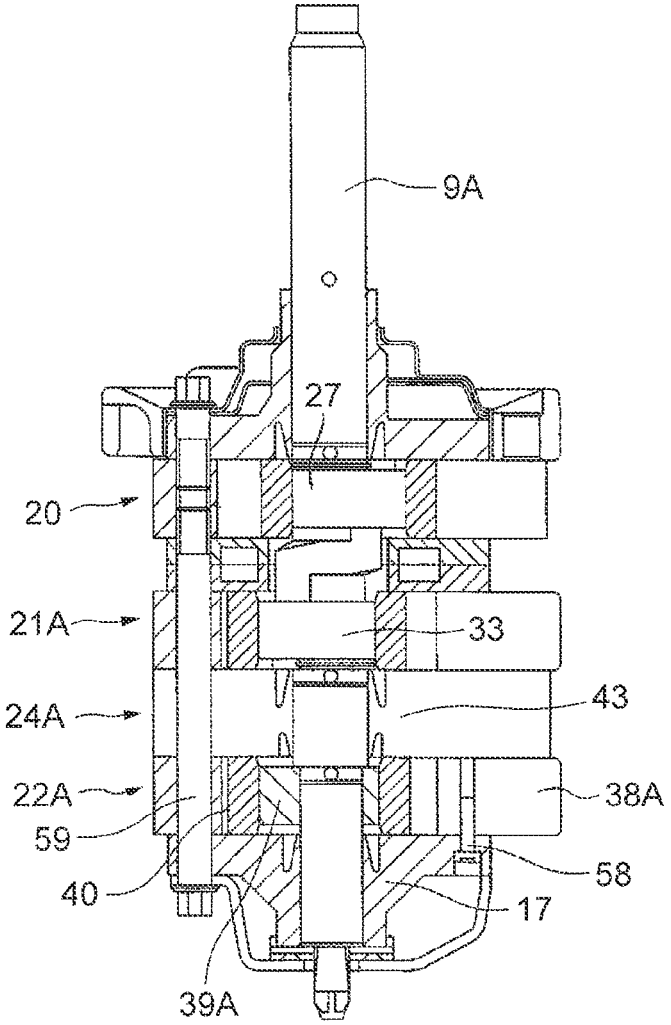
FIG. 6 is a cross sectional view showing an assembling procedure of a compression mechanism body.

FIGS. 4 to 6 show the assembly procedure of the compression mechanism body 11A. In FIG. 4, the primary bearing 16 and the first compression mechanism section 20 are attached to the rotating shaft 9A. The first cylinder 26 of the first compression mechanism section 20 and the primary bearing 16 positioned in close proximity to this first cylinder 26 are fixed by the cylinder alignment bolt 55 on a one-to-one basis by the cylinder center and the bearing center being matched.

In FIG. 5, furthermore, the first partition plate 23, the second compression mechanism section 21A, and the second partition plate 24A are attached to the rotating shaft 9A. The second cylinder 32A of the second compression mechanism section 21A and the second partition plate 24A positioned in close proximity to this second cylinder 32A are fixed by the cylinder alignment bolt 56 on a one-to-one basis by the cylinder center and the bearing center being matched.

Furthermore, the second partition plate 24A constituting the partition plate bearing 43 and the primary bearing 16 are fixed by the inter-shaft alignment bolt 57, and these bearings 43 and 16 are aligned with reference to the rotating shaft 9A.

In FIG. 6, furthermore, the third compression mechanism section 22A and the secondary bearing 17 are attached to the rotating shaft 9A. The third cylinder 38A of the third compression mechanism section 22A and the secondary bearing 17 positioned in close proximity to this third cylinder 38A are fixed by the cylinder alignment bolt 58 on a one-to-one basis by the cylinder center and the bearing center being matched. Furthermore, the secondary bearing 17, the second partition plate 24A constituting the partition plate bearing 43, and the primary bearing 16 are fixed by the inter-shaft alignment bolt 59, and these bearings 16, 43, and 17 are aligned with reference to the rotating shaft 9A.

In such a configuration, in this second embodiment, the third eccentric section 39A is formed by a separate component from the rotating shaft 9A and is attached to the rotating shaft 9A.

Therefore, when the second partition plate 24A constituting the partition plate bearing 43 is attached to the rotating shaft 9A, the third eccentric section 39A can be attached to the rotating shaft 9A after the second partition plate 24A is attached to the rotating shaft 9A.

Thus, the second partition plate 24A is no longer necessary to be divided as described in the first embodiment, and it is possible to provide an inexpensive and highly reliable second partition plate 24A.

In addition, the third eccentric section 39A formed by a separate component from the rotating shaft 9A is provided on the third compression mechanism section 22A side of the second partition plate 24A as the boundary, including a smaller number of compression mechanism sections, and the first and the second eccentric sections 27 and 33 of the first and the second compression mechanism sections 20 and 21A are formed integrally with the rotating shaft 9A.

For this reason, the number of the eccentric sections formed by a separate component can be reduced, and a compressor body 2A with good productivity by the reduced number of the eccentric sections to be separate components can be provided.

A suction passage 52 connected to the second suction pipe 51 is formed in the second partition plate 24A, and the gas refrigerant flown into the suction passage 52 through the inside of the second suction pipe 51 is sucked into the second and the third cylinder chambers 31 and 37. Therefore, the supply of the gas refrigerant into two chambers of the second and the third cylinder chambers 31 and 37 can be performed by a single second suction pipe 51, and the number of the suction pipes can be reduced.

The second partition plate 24A has larger thickness dimensions along the axial direction of the rotating shaft 9A by forming the suction passage 52 therein, and this second partition plate 24A constitutes the partition plate bearing 43, and therefore, the second partition plate 24A has an effect allowing reduction of the deflection of the rotating shaft 9A even if the thickness dimensions of the second partition plate 24A is increased.

The second discharge hole 36 of the second compression mechanism section 21A is formed in the first partition plate 23 positioned on the opposite side of the side where the second cylinder chamber 31 and the suction passage 52 are connected, and the third discharge hole 42 of the third compression mechanism section 22A is formed in the secondary bearing 17 positioned on the opposite side of the side where the third cylinder chamber 37 and the suction passage 52 are connected.

For this reason, the second and the third discharge holes 36 and 42 and the discharge passages leading to these second and the third discharge holes 36 and 42 can be formed sufficiently large without being affected by the suction passage 52 and the partition plate bearing 43, and the performance of the multiple cylinder rotary compressor 4A can be improved by the discharge loss being reduced.

The annular grooves 53 and 54 are formed in the second partition plate 24A, the partition plate bearing 43 is likely to follow the deflection of the rotating shaft 9A by these annular grooves 53 and 54 being formed, the area where the partition plate bearing 43 and the rotating shaft 9A come in contact can be secured, and the support for the rotating shaft 9A by the partition plate bearing 43 can be favorably performed.

Moreover, the depth dimensions of the annular groove 53 on the side where two compression mechanism sections (the first and the second compression mechanism sections 20 and 21A), where the deflection of the rotating shaft 9A is likely to increase, are positioned are increased, and therefore, the support for the rotating shaft 9A by the partition plate bearing 43 can be performed even more favorably.

On the other hand, the depth dimensions of the annular groove 54 on the side, where one compression mechanism section (the third compression mechanism section 22A) is positioned and the deflection of the rotating shaft 9A is smaller, are reduced, and therefore, the interference between the annular grooves 53 and 54 can be prevented, and the depth dimensions of the annular groove 53 can be further increased.

The opposite side of the electric motor section 10 across the second partition plate 24A, that is, the lower side of the figure is not affected by the whirling of the electric motor section 10, in addition, the compression reaction force is also small because the number of the compression mechanism sections is also small, and therefore, the external dimensions of the rotating shaft 9A are set as "D1", and it can be made smaller than the external dimensions "D2" of the other parts of the rotating shaft 9A.

As a result, the external dimensions of the third eccentric section 39A can be reduced, and the sliding loss between the third eccentric section 39A and the third roller 40 can be reduced.

Furthermore, the inner diameter dimensions of the secondary bearing 17 can be reduced, and the sliding loss between the secondary bearing 17 and the rotating shaft 9A can be reduced.

The first and the second eccentric sections 27 and 33 formed integrally with the rotating shaft 9A and the third eccentric section 39A formed by a separate component from the rotating shaft 9A are formed in the same external dimensions and eccentric amount with respect to the rotation center. As a result, the first to the third rollers 28, 34, and 40 can be the same shape, and the unification of components can be achieved.

When the compression mechanism body 11A is assembled, the first cylinder 26 and the primary bearing 16 are fixed by the cylinder alignment bolt 55 by the cylinder center and the bearing center being matched (see FIG. 4), and the second cylinder 32A and the second partition plate 24A are fixed by the cylinder alignment bolt 56 by the cylinder center and the bearing center being matched (see FIG. 5). In addition, the third cylinder 38A and the secondary bearing 17 are fixed by the cylinder alignment bolt 58 by the cylinder center and the bearing center being matched (see FIG. 6).

Therefore, the alignment between the cylinder center and the bearing center can be performed with high dimensional accuracy, and a highly reliable compressor body 2A can be provided.

Furthermore, the second partition plate 24A constituting the partition plate bearing 43 and the primary bearing 16 are fixed by the inter-shaft alignment bolt 57 (see FIG. 5), and the secondary bearing 17, the second partition plate 24A, and the primary bearing 16 are fixed by the inter-shaft alignment bolt 59 (see FIG. 6), whereby the deviation of the bearing center of each of the bearings 16, 43, and 17 is reduced, and a highly reliable compressor body 2A can be provided.

It should be noted that although in each of the embodiments described above, the case where the roller and the blade of each of the compression mechanism sections are separately formed, and the tip end portion of each of the blades abuts on the outer peripheral portion of a corresponding one of the rollers is described, the present invention is not limited thereto, and the roller and the blade of each of the compression mechanism sections may be integrally formed.

REFERENCE SIGNS LIST

1 refrigeration cycle apparatus
2 compressor body
2A compressor body
4 multiple cylinder rotary compressor
4A multiple cylinder rotary compressor
5 condenser
6 expansion device
7 evaporator
8 hermetic case
9 rotating shaft
9A rotating shaft
10 electric motor section
11 compression mechanism body
11A compression mechanism body
16 primary bearing
17 secondary bearing
20 first compression mechanism section
21 second compression mechanism section
21A second compression mechanism section
22 third compression mechanism section
22A third compression mechanism section
23 first partition plate
24 second partition plate
24A second partition plate
25 first cylinder chamber
26 first cylinder
27 first eccentric section
28 first roller
29 first blade
31 second cylinder chamber
32 second cylinder
32A second cylinder
33 second eccentric section
34 second roller
35 second blade
37 third cylinder chamber
38 third cylinder
38A third cylinder
39 third eccentric section
39A third eccentric section
40 third roller
41 third blade
43 partition plate bearing
52 suction passage While certain embodiments have been described, these embodiments have been presented by way of example only, and are not intended to limit the scope of the inventions. Indeed, the novel embodiments described herein may be embodied in a variety of other forms; furthermore, various omissions substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A multiple cylinder rotary compressor comprising:

a compressor body including a hermetic case, the hermetic case housing inside a rotating shaft rotatable around a central axis, an electric motor section connected to one end side of the rotating shaft, and a compression mechanism body connected to a second end side of the rotating shaft;

the compression mechanism body including:

a first compression mechanism section, a second compression mechanism section adjacent to the first compressor mechanism, and a third compression mechanism section adjacent to the second compressor mechanism, and arranged so as to stack with each other in an axial direction of the rotating shaft, a first partition plate disposed between the first compression mechanism section and the second compression mechanism section, and a second partition plate disposed between the second compression mechanism section and the third compression mechanism section, wherein a distance of the second partition plate from the electric motor section is greater than a distance of the first partition plate from the electric motor section, and a primary bearing and a secondary bearing supporting the rotating shaft on both end sides of the compression mechanism body along the axial direction of the rotating shaft; and the compression mechanism sections each including:

a cylinder forming inside a respective cylinder chamber, an eccentric section, attached to the rotating shaft and disposed in the respective cylinder chamber, a roller, fitted to the eccentric section and rotating eccentrically within the respective cylinder chamber during a rotation of the rotating shaft, and a blade dividing the inside of the cylinder chamber into two, wherein the second partition plate is formed as one component that is not divided and constitutes a partition plate bearing supporting the rotating shaft by keeping the second partition plate in sliding contact with an outer peripheral surface of the rotating shaft, the eccentric sections, disposed in the respective cylinder chambers of the first compression mechanism section and the second compression mechanism section, are formed integrally with the rotating shaft, the eccentric section, disposed in the respective cylinder chamber of the third compression mechanism, is formed as a separate component from the rotating shaft and attached to the rotating shaft a suction passage, supplying a working fluid to the second compression mechanism section and the third compression mechanism section, is formed in the second partition plate, wherein the second partition plate does not have a discharge hole, and wherein the first partition plate has a discharge hole.

2. The multiple cylinder rotary compressor according to claim 1, wherein an external dimension of a portion of the rotating shaft, to which the eccentric section disposed in the cylinder chamber of the third compression mechanism section is attached, is formed smaller than a sliding diameter dimension of the partition plate bearing.

3. A refrigeration cycle apparatus comprising:

a multiple cylinder rotary compressor according to claim 1;

a condenser connected to the multiple cylinder rotary compressor;

an expansion device connected to the condenser; and an evaporator connected between the expansion device and the multiple cylinder rotary compressor.

* * * * *